US010938086B2

(12) United States Patent
Offermann et al.

(10) Patent No.: US 10,938,086 B2
(45) Date of Patent: Mar. 2, 2021

(54) GLASS PANE HAVING AN ELECTRICAL HEATING ASSEMBLY

(71) Applicant: SAINT-GOBAIN GLASS FRANCE, Courbevoie (FR)

(72) Inventors: Volkmar Offermann, Eschweiler (DE); Stefan Droste, Herzogenrath (DE)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 233 days.

(21) Appl. No.: 16/329,564

(22) PCT Filed: Jul. 26, 2017

(86) PCT No.: PCT/EP2017/068849
§ 371 (c)(1),
(2) Date: Feb. 28, 2019

(87) PCT Pub. No.: WO2018/041480
PCT Pub. Date: Mar. 8, 2018

(65) Prior Publication Data

US 2019/0198970 A1 Jun. 27, 2019

(30) Foreign Application Priority Data

Sep. 5, 2016 (EP) ..... 16187170

(51) Int. Cl.
*H01Q 1/12* (2006.01)
*H05B 3/84* (2006.01)

(52) U.S. Cl.
CPC ..... *H01Q 1/1278* (2013.01); *H05B 3/84* (2013.01); *H05B 2203/003* (2013.01); *H05B 2203/011* (2013.01)

(58) Field of Classification Search
CPC ..... H05B 3/84; H05B 3/0042; H05B 3/16; H05B 3/18; H05B 3/86; H05B 2203/016;
(Continued)

(56) References Cited

U.S. PATENT DOCUMENTS 3,928,748 A 12/1975 Sauer
2008/0083720 A1 4/2008 Gentile et al.

FOREIGN PATENT DOCUMENTS

DE 40 345 48 C2 5/1992
EP 1 905 579 A1 4/2008
FR 2 909 340 A1 6/2008

OTHER PUBLICATIONS

International Search Report as issued in International Patent Application No. PCT/EP2017/068849, dated Oct. 25, 2017.

*Primary Examiner* — Shawntina T Fuqua
(74) *Attorney, Agent, or Firm* — Pillsbury Winthrop Shaw Pittman LLP

(57) ABSTRACT

A glass pane includes an electrical heating assembly for use with an operating voltage of more than 14 V. A part of the heating assembly is adapted for acting as an antenna and the heating assembly has a first and a second number of electrically conductive meandering sections. The meandering sections within the first or second number, respectively, are arranged parallel to one another substantially in a first orientation. The respective beginnings and ends of the meandering sections within the first or second number, respectively, each end at a common electrical conductor, which extends in each case substantially perpendicular to the first orientation. One of the electrical conductors extended substantially perpendicular to the first orientation acts as an antenna and has, during use with the operating voltage, a potential different from the operating voltage.

11 Claims, 4 Drawing Sheets

(58) Field of Classification Search
CPC ..... H05B 2203/031; H05B 2203/037; H05B 2203/035; H05B 2203/003; H05B 2203/004; H05B 2203/007; H05B 2203/008; H05B 2203/013; H05B 2203/011; H05B 1/0294; H05B 1/0236; H01Q 1/1278; H01Q 1/1271; H01Q 1/1285; B60S 1/026; B60S 1/023; B60S 1/02; B32B 17/10036; B32B 17/10385; B32B 17/10376
See application file for complete search history.

GLASS PANE HAVING AN ELECTRICAL HEATING ASSEMBLY

CROSS REFERENCE TO RELATED APPLICATIONS

This application is the U.S. National Stage of PCT/EP2017/068849, filed Jul. 26, 2017, which in turn claims priority to European Patent Application No. 16187170.2 filed Sep. 5, 2016, the entire contents of all applications are incorporated herein by reference in their entireties.

The invention relates to a glass pane having an electrical heating assembly.

BACKGROUND OF THE INVENTION

Glass panes that are electrically heatable are used nowadays in many areas. The best-known applicational areas are heatable vehicle window panes.

Increasingly, however, other functions, in particular antenna functions, are also being taken over by the previous heating assemblies. With the integration of antenna functions, wind noises on the vehicle are minimized and damage to the antennas is also prevented. Reference is made, by way of example, to DE 40 345 48 C2.

From US patent application US 2008/083720 A1, it is known that heating wires can be applied on a glass substrate. The heating wires can be arranged sinusoidally. The document further presents a textile mat with heating wires as an antenna. However, no statement is made about the regions of the heating wires that act as an antenna or their arrangement.

The heating wires were generally applied on the pane by means of printing technology, for instance, screen printing.

Strict limits apply to the design of the heating wires. For one thing, these result from the fact that the heating of the glass pane should be done as uniformly as possible to avoid thermally induced damage; for another, the structure sizes are limited such that the view through the pane is not too greatly impaired. On the other hand, the production process imposes limits such that the printed heating wires have a certain specific resistance and certain structure sizes.

In prior art systems that were designed for the previously customary voltages in typical vehicle electrical systems of 12-14 V, the integration was readily possible.

However, for several years, there has already been an effort to increase the voltage of the vehicle electrical system.

However, when the onboard voltage is increased, the heat transformation also increases with the same structure sizes. A reduction in structure sizes and/or an increase in the resistance of the heating wires is, however, not readily possible.

This is, for example, due to the fact that a reduction in the content of conductive particles (an increase in resistance) results in the degradation of the printing, in particular in increasing porosity and thus results in more numerous errors. Considering the dimensions, compensation of a four times higher operating voltage would require increasing the resistance by a factor of $4^2$ with the same design. In other words, either the specific resistance of the conductor would have to increase by a factor of 16, or the dimensions of the conductor (layer width/layer thickness) would have to decrease correspondingly. However, there are, for process technology reasons, minimum structural widths in the range of 0.2 mm.

But even a combination does not meet the objective because even with the use of the minimum structural widths, the resistance would still have to be so high that the printing is error-prone.

Alternatively, it would be possible to consider controlling the flow of the operating voltage similarly to pulse width control. However, in the case of a malfunction, the glass pane would be at serious risk. In addition, active control of the flow requires additional error-prone and costly elements.

Consequently, an object of the invention is to make available a glass pane having an electrical heating assembly that can be used even with an operating voltage of 14 V or more.

SUMMARY OF THE INVENTION

The object is accomplished by a glass pane having an electrical heating assembly suitable for use with an operating voltage of more than 14 V, wherein at least one part of the heating assembly is also suitable for acting as an antenna, wherein the heating assembly has at least one first number of electrically conductive meandering sections and a second number of electrically conductive meandering sections, wherein the meandering sections within the first number or within the second number, respectively, are arranged parallel to one another substantially in a first orientation, wherein the respective beginnings and ends of the meandering sections within the first number or within the second number each end at a common electrical conductor, which extends in each case substantially perpendicular to the first orientation, wherein at least one of the electrical conductors extended substantially perpendicular to the first orientation acts as an antenna.

One meander $M_1$, $M_2$ represents one loop, cf. FIG. 4. In the example of FIG. 4, the meander $M_1$ is oriented horizontally in a first orientation, in other words, the opening of the loop points in a horizontal direction. The meanders $M_1$, $M_2$ are arranged parallel to one another. Whereas the meander $M_1$ is opened toward the left in the horizontal direction, the meander $M_2$ is opened toward the right in the horizontal direction.

This enables both increasing the operating voltage and retaining the previous functions.

In an improvement of the invention, at least parts of the heating assembly are applied or introduced as wires on or in a combination film F of a composite glass pane.

This enables providing the heating assembly protected against mechanical influences.

According to another embodiment of the invention, the antenna has its own antenna connection for connecting to one or a plurality of high-frequency devices.

Thus, the antenna can be attached at a suitable location.

In another embodiment of the invention, the antenna has a filter for separating high-frequency signals and DC voltage such that DC voltage does not interfere with the reception of high-frequency signals.

According to another embodiment of the invention, the heating assembly is suitable for use with an operating voltage of approx. 48 V.

Thus, even high operating voltages, as are encountered, for example, in vehicles with electrical drive or electrically assisted drive, can be used directly without further conversion and thus without conversion loss.

In another embodiment of the invention, the electrical conductor and/or the electrically conductive meandering sections have a minimum structural width equal to or greater than 0.1 mm and a maximum structural width less than 2 mm.

Thus, with conventional structure widths and production methods, a glass pane that can be operated even with operating voltages higher than 14 V can be readily provided.

According to another embodiment of the invention, the antenna is suitable for receiving high-frequency signals, in particular keyless entry systems, analog/digital broadcast and/or mobile communication signals.

Thus, a broad spectrum of functions relative to reception and transmission of electromagnetic radiation can be provided with the heating assembly.

According to one embodiment of the invention, the heating assembly includes silver.

Thus, with conventional production methods, a glass pane that can be operated even with operating voltages higher than 14 V can readily be provided.

In another embodiment of the invention, the glass pane further has at least one electrical filter to decouple the operating voltage and the antenna.

Through the provision of filtering, the operational safety of high-frequency devices that are connected to the antenna is increased.

The object is also accomplished by use of a previously described glass pane according to the invention in vehicles, in particular as a rear window.

BRIEF DESCRIPTION OF THE DRAWINGS

Embodiments of the present invention are described by way of example with reference to the appended drawings, which depict.

DETAILED DESCRIPTION OF THE INVENTION WITH REFERENCE TO THE DRAWINGS

In the following, the invention is presented in more detail with reference to the figures. It should be noted that various aspects are described that can each be used individually or in combination. In other words, any aspect can be used with different embodiments of the invention unless explicitly represented as a pure alternative.

Furthermore, in the following, for the sake of simplicity, reference is usually made to only one entity. Unless explicitly noted, the invention can, however, in each case, have a plurality of the entities concerned. Thus, the use of the words "a", "an", and "one" must be understood merely as an indication of the fact that at least one entity is used in a simple embodiment.

Figure 1:
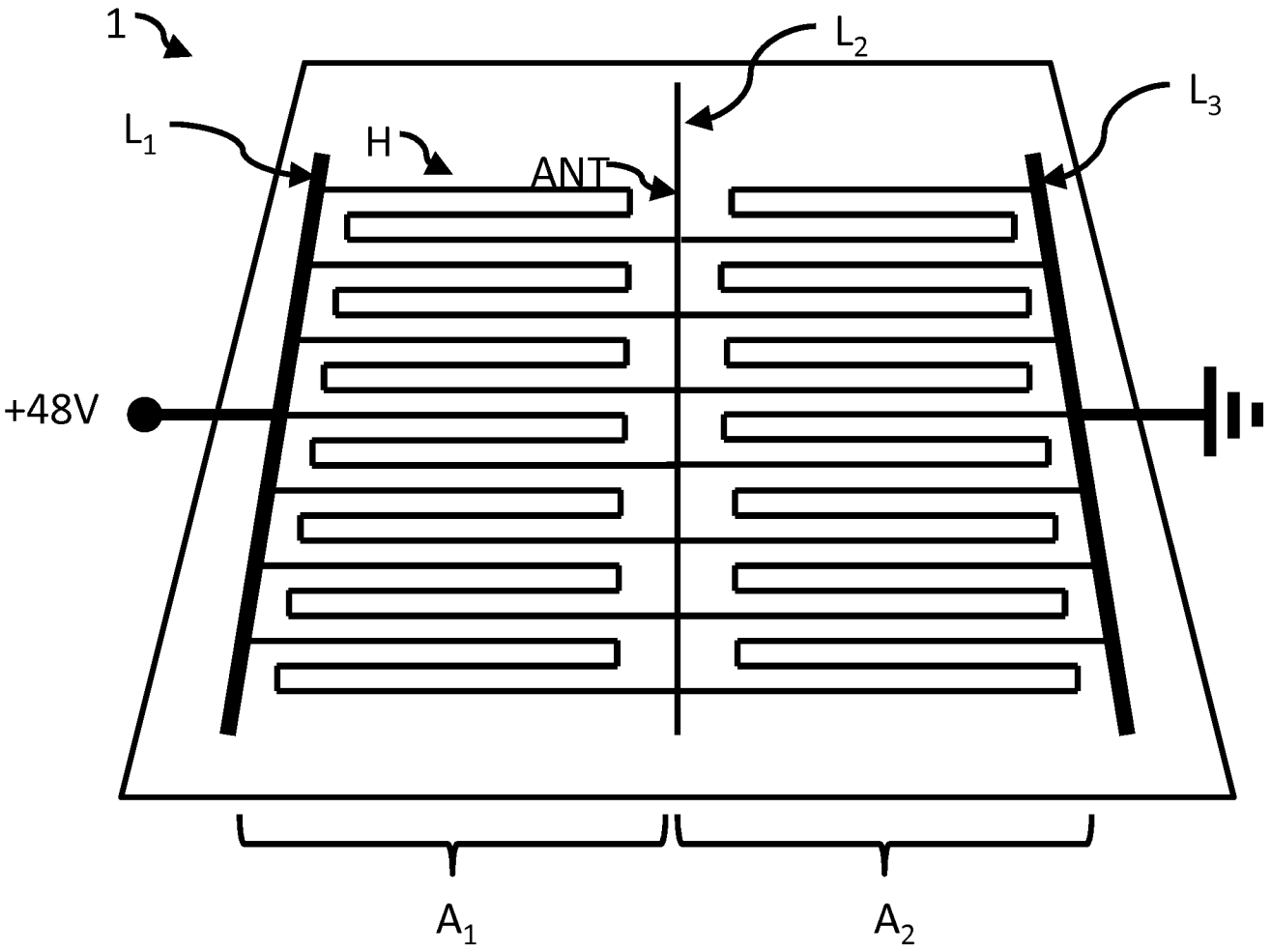
FIG. 1 a first schematic representation of a glass pane having an electrical heating assembly according to embodiments of the invention, FIG. 2 a second schematic representation of a glass pane having an electrical heating assembly according to embodiments of the invention, FIG. 3 further aspects according to embodiments of the invention, and FIG. 4 a schematic representation of meanders.
Figure 2:
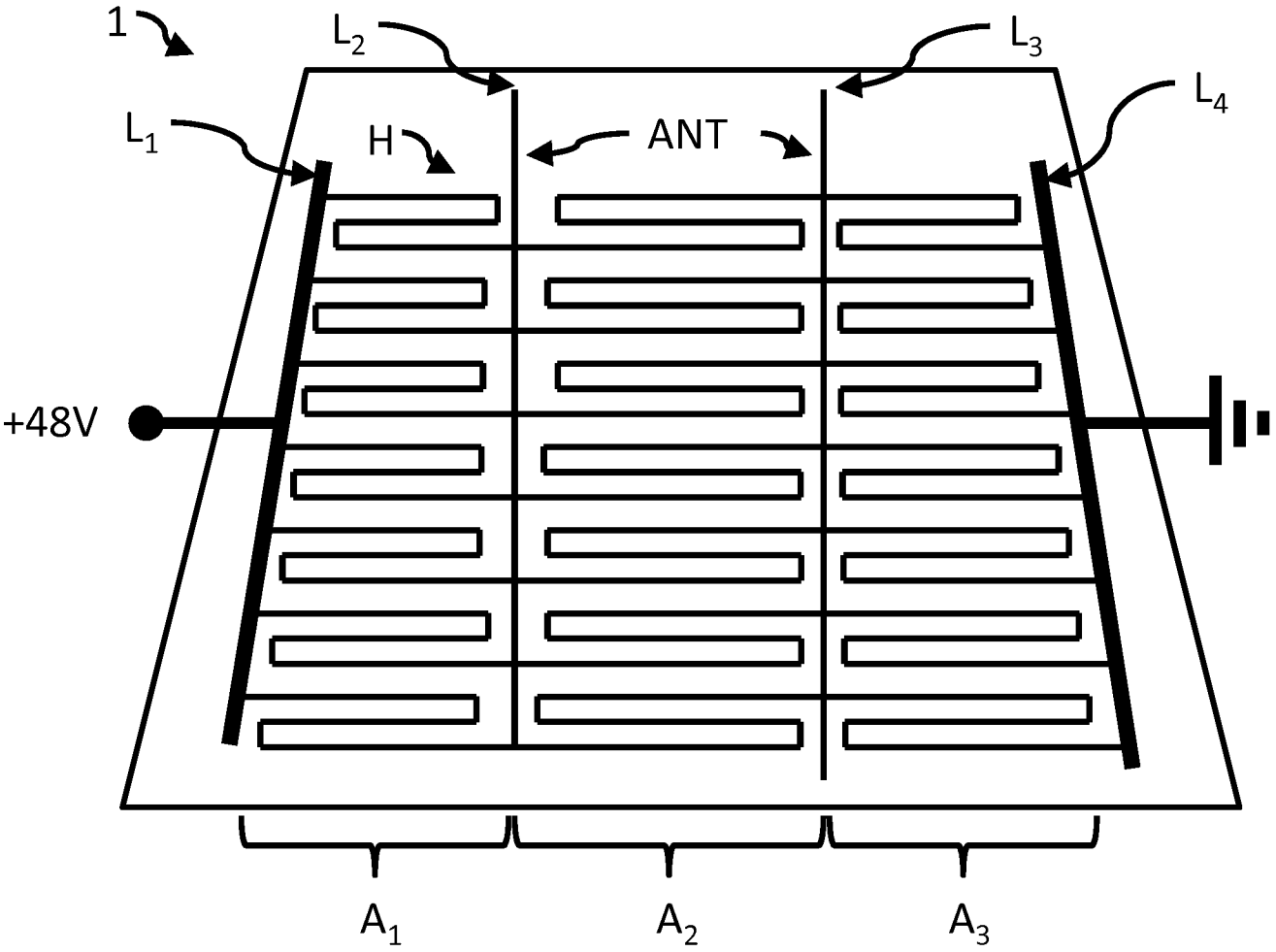

FIGS. 1 and 2 schematically depict embodiments of a glass pane 1. The glass pane 1 is equipped with a heating assembly H that is suitable for use with an operating voltage of more than 14 V.

At least one part of the heating assembly H is also suitable for acting as an antenna ANT. Here, "antenna" means that electromagnetic radiation can be received and/or transmitted. In this connection, "electromagnetic radiation" means any modulated or un-modulated electromagnetic radiation that serves for the transmission of information.

The heating assembly H has at least one first number of electrically conductive meandering sections $A_1$ and a second number of electrically conductive meandering sections $A_2$. In FIG. 1, the heating assembly H has a first number of electrically conductive meandering sections $A_1$ and a second number of electrically conductive meandering sections $A_2$; in FIG. 3, the heating assembly H has a first number of electrically conductive meandering sections $A_1$ and a second number of electrically conductive meandering sections $A_2$ and a third number of electrically conductive meandering sections $A_3$. The heating assembly can, however, also readily have even more numbers of meandering sections.

Figure 3:
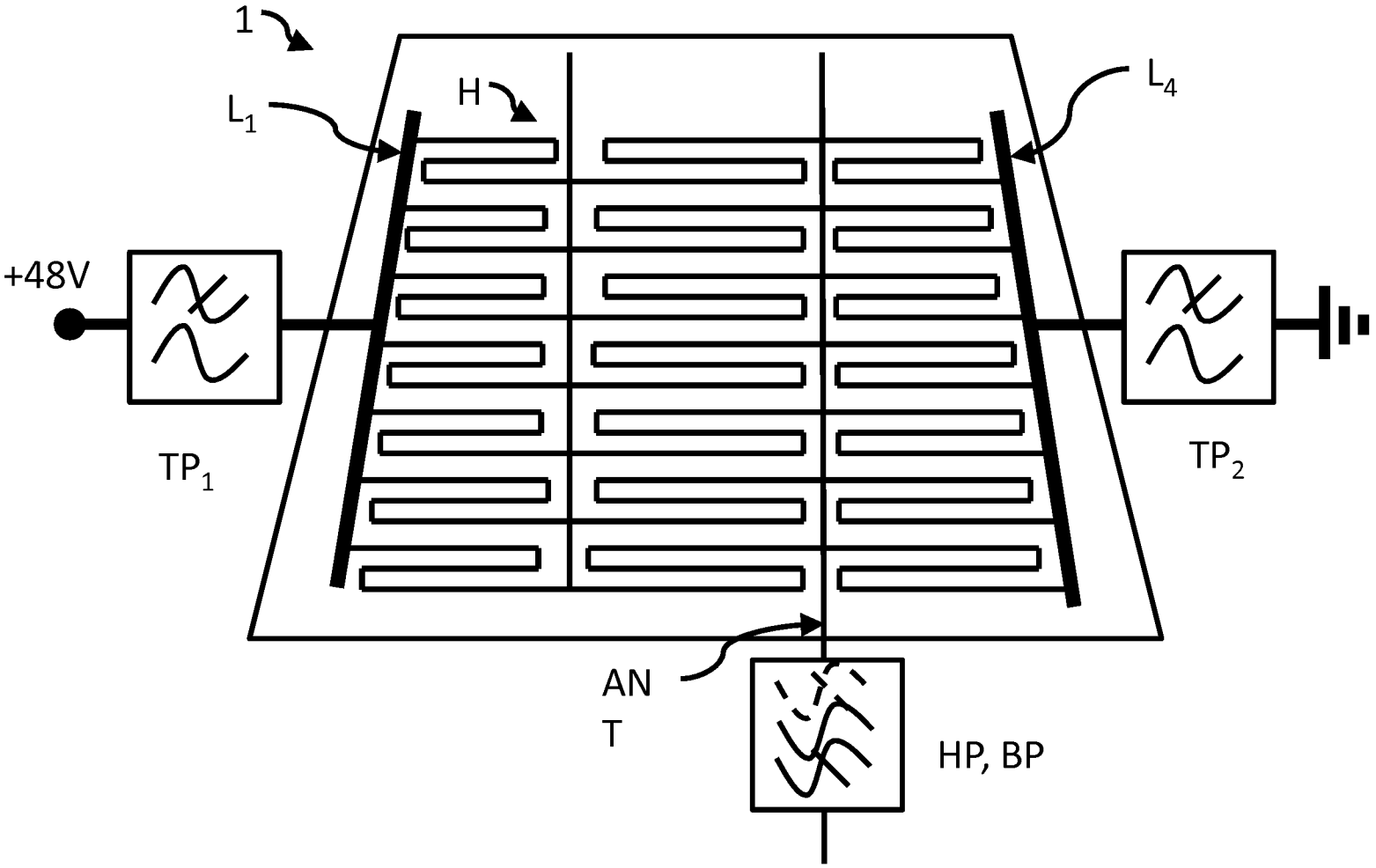
Figure 4:
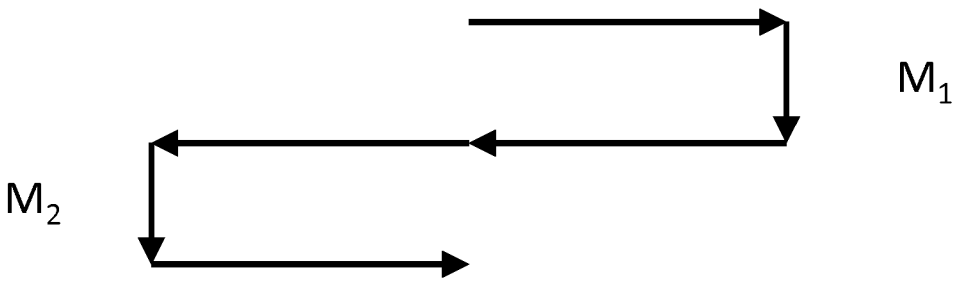

The meandering sections within the first number or within the second number, respectively, in FIG. 1 are arranged parallel to one another substantially in a first orientation. Likewise, the meandering sections within the first number or within the second number and within the third number, respectively, in FIG. 3 are arranged parallel to one another substantially in a first orientation.

The respective beginnings and ends of the meandering sections within the first number or within the second number each end on a common electrical conductor, which extends in each case substantially perpendicular to the first orientation.

In other words, in FIG. 1, the beginnings of the meandering sections $A_1$ within the first number end on a common electrical conductor $L_1$, which extends in each case substantially perpendicular to the first orientation, while the ends of the meandering sections $A_2$ within the second number end on a common electrical conductor $L_3$, which extends in each case substantially perpendicular to the first orientation. The ends of the meandering sections $A_1$ within the first number and the beginnings of the meandering sections $A_2$ within the second number end at a common electrical conductor $L_2$, which extends in each case substantially perpendicular to the first orientation.

In FIG. 2, the beginnings of the meandering sections $A_1$ within the first number end on a common electrical conductor $L_1$, which extends in each case substantially perpendicular to the first orientation, while the ends of the meandering sections $A_3$ within the third number end on a common electrical conductor $L_3$, which extends in each case substantially perpendicular to the first orientation. The ends of the meandering sections $A_1$ within the first number and the beginnings of the meandering sections $A_2$ within the second number end on a common electrical conductor $L_2$, which extends in each case substantially perpendicular to the first orientation. Likewise, the ends of the meandering sections $A_2$ within the second number and the beginnings of the meandering sections $A_3$ within the third number end on a common electrical conductor $L_3$, which extends in each case substantially perpendicular to the first orientation.

At least one of the electrical conductors extended perpendicular to the first orientation acts as an antenna.

The at least one of the electrical conductors ($L_2$; $L_2$, $L_3$) extended perpendicular to the first orientation that acts as an antenna (ANT), has, during use with the operating voltage, a potential different from the operating voltage.

The assembly of the invention presented makes it possible, in particular, to consider the common conductors $L_1$, $L_2$, $L_3$, $L_4$, . . . as equipotential planes such that within the respective conductor, there is no appreciable current flow perpendicular to the first orientation. In other words, since the current flow occurs substantially "in the first orientation", there is no current flow to the electrical conductors caused by the operating voltage such that undesirable hot-spots cannot occur on the pane 1. In other words, homogeneous heat distribution is enabled. However, at the same time, the function as an antenna ANT is still ensured.

The number of the meandering sections and the length of the meandering sections can be suitably adjusted such that a desired heat output can be achieved with a certain glass thickness and operating voltage.

The antenna ANT can be provided with one or a plurality of contact elements at a suitable location. Thus, for example, different frequency ranges can be served and/or transmitters and receivers can be decoupled from one another and/or a diversity system can be served or spatial multiplexing (MIMO) can be enabled. The diversity system includes switch diversity and phase diversity on the receiver side of the system in order to advantageously use the various reception properties of multiple antennas and, thus, for example, to improve omnidirectionality.

According to one embodiment of the invention, at least parts of the heating assembly H are applied or introduced as wires on or in the combination film F of a composite glass pane. In other words, the invention is not limited to the area of certain glass panes. The term "wire" should not be misconstrued. Instead, "wire" must be understood as an assembly that is relatively long in relation to the thickness/width of the conductor. In particular, the term also includes (screen) printed conductors.

In one embodiment of the invention, the antenna ANT has its own antenna connection for connecting to one or a plurality of high-frequency devices. A high-frequency device can, for example, be a diplexer or the like, but also even an amplifier and/or a transmitter.

According to another embodiment of the invention, the antenna ANT has at least one filter for separating high-frequency signals and DC voltage such that DC voltage does not interfere with the reception of high-frequency signals. For example, FIG. 3 depicts an assembly with 3 filters, wherein the assembly need not necessarily be like this. The term "filter" is to be understood broadly and can also include a frequency barrier.

The filter can also be provided on the glass pane 1 using printing technology, for example, as a strip line, or as sketched in FIG. 3 as independent elements.

For example, a low pass filter can be provided or a plurality of low pass filters $TP_1$, $TP_2$ can be provided to prevent high-frequency signals from penetrating into the vehicle electrical system (indicated by 48 V and and a ground symbol). The low pass filter can be passed by the respective operating voltage—typically a DC voltage—whereas the high-frequency of a transmitter, for example, of a mobile radio transmitter is not distributed over the vehicle electrical system and, thus, interference, for example, on the vehicle electronic system, or unwanted emissions can be avoided. The provision of two low pass filters is not necessary. It frequently suffices to provide a low pass filter $TP_1$ on the supply voltage side of the operating voltage. On the other hand, providing an inductor, for example, on the supply voltage side (48 V) can suffice as a filter. Primarily, filters and coils serve to protect the antenna against interference from the onboard electrical system or to prevent a high-frequency short-circuit of the antenna with the vehicle ground and the supply voltage side.

Similarly, a high pass filter HP or bandpass filter BP can be provided to protect the high-frequency devices against penetration of DC voltage. Here as well, the provision of a capacitor as a (high pass) filter HP can suffice. In this manner, the often sensitive transmission/receiving/amplification electronics of the high-frequency device can be protected against penetration of DC voltage. Penetrating operating voltage can result in destruction or impairment of the high-frequency device.

In another embodiment of the invention, the heating assembly H is suitable for use with an operating voltage of approx. 48 V. This enables a wide range of operating voltages.

In one embodiment of the invention, the electrical conductor and/or the electrically conductive meandering sections have a minimum structural width equal to or greater than 0.1 mm and a maximum structural width less than 2 mm.

According to another embodiment of the invention, the antenna is suitable for receiving high-frequency signals, in particular keyless entry systems, analog broadcasting, such as longwave, medium wave, shortwave, and ultra-shortwave broadcasting, digital broadcasting, such as, DAB, DAB+, DRM, DVB-T, DVB-T2, and for mobile communication signals, for example, according to one of the standards GSM, UMTS, LTE, or the like. Broadcasting includes both radio and television signals.

Here, for example, in particular, the conductors $L_2$ or $L_2$ as well as $L_3$ extended perpendicular to the first orientation can act as an antenna ANT. These can have dimensioning suitable for the function as an antenna and are particularly suited by the orientation perpendicular to the first orientation for receiving signals polarized in this direction (but also for circularly polarized signals). However, the sections of the meandering sections $A_1$, $A_2$, $A_3$ . . . extended in the first orientation can also act as an antenna ANT. These can have dimensioning suitable for the function as an antenna and are particularly suited by the first orientation for receiving signals polarized in this direction (but also for circularly polarized signals).

In particular, in embodiments of the invention, the heating arrangement H includes silver. For example, silver paste can be applied to the glass pane 1 using screen printing technology.

According to one embodiment of the invention, the use of the glass pane 1 according to the invention is intended in vehicles, in particular land vehicles, and in particular as a rear window.

The invention claimed is:

1. A glass pane comprising an electrical heating assembly adapted for use with an operating voltage of more than 14 V, wherein at least one part of the heating assembly is also adapted for acting as an antenna, wherein the heating assembly has at least one first number of electrically conductive meandering sections and a second number of electrically conductive meandering sections, wherein the meandering sections within the first number of electrically conductive meandering sections or within the second number of electrically conductive meandering sections, respectively, are arranged parallel to one another substantially in a first orientation, wherein the respective beginnings and ends of the meandering sections within the first number of electrically conductive meandering sections or within the second number of electrically conductive meandering sections, each end at a common electrical conductor, which extends in each case substantially perpendicular to the first orientation, wherein at least one of the electrical conductors extended substantially perpendicular to the first orientation acts as an antenna, wherein the at least one of the electrical conductors extended substantially perpendicular to the first orientation, which acts as an antenna, has, during use with the operating voltage, a potential different from the operating voltage.

2. The glass pane according to claim 1, wherein at least parts of the heating assembly are applied or introduced as wires on or in the combination film.

3. The glass pane according to claim 1, wherein the antenna has its own antenna connection for connecting to one or a plurality of high-frequency devices.

4. The glass pane according to claim 1, wherein the antenna has a filter for separating high-frequency signals and DC voltage such that DC voltage does not interfere with the reception of high-frequency signals.

5. The glass pane according to claim 1, wherein the heating assembly is adapted for use with an operating voltage of approximately 48 V.

6. The glass pane according to claim 1, wherein the electrical conductor and/or the electrically conductive meandering sections have a minimum structural width equal to or greater than 0.1 mm and a maximum structural width less than 2 mm.

7. The glass pane according to claim 1, wherein the antenna is adapted for receiving high-frequency signals, including keyless entry systems, analog/digital broadcast including TV and mobile communication signals.

8. The glass pane according to claim 1, wherein the heating assembly includes silver.

9. The glass pane according to claim 1, further comprising at least one electrical filter in order to decouple the operating voltage and the antenna.

10. A method comprising arranging a glass pane according to claim 1 in vehicles.

11. The method according to claim 10, wherein the glass pane is a rear window.

* * * * *